United States Patent [19]

Nations

[11] Patent Number: 4,595,058

[45] Date of Patent: Jun. 17, 1986

[54] TURBULENCE CEMENTING SUB

[75] Inventor: Joe F. Nations, Slidell, La.

[73] Assignee: Shell Oil Company, Houston, Tex.

[21] Appl. No.: 645,141

[22] Filed: Aug. 28, 1984

[51] Int. Cl.[4] ..... E21B 33/14; E21B 17/00

[52] U.S. Cl. ..... 166/285; 166/242; 166/380

[58] Field of Search ..... 166/285, 286, 380, 241–243, 166/173, 208; 175/323, 324, 325; 308/4 A

[56] References Cited

U.S. PATENT DOCUMENTS

| | | | |
|---|---|---|---|
| 1,659,327 | 2/1928 | Montgomery | 175/323 |
| 1,807,050 | 5/1931 | Stolz | 166/285 |
| 2,295,803 | 9/1942 | O'Leary | 166/222 |
| 2,352,412 | 6/1944 | Sandstone | 175/323 |
| 2,667,930 | 2/1954 | Saurenman et al. | 166/173 |
| 3,072,195 | 1/1963 | Kluck | 166/177 |
| 3,087,550 | 4/1963 | Tyrrell, Jr. | 166/241 |
| 3,176,771 | 4/1965 | Claiborne et al. | 166/241 |
| 3,351,136 | 11/1967 | Nelson | 166/241 |

FOREIGN PATENT DOCUMENTS

| | | | |
|---|---|---|---|
| 2134947 | 8/1984 | United Kingdom | 166/285 |

*Primary Examiner*—James A. Leppink
*Assistant Examiner*—Hoang C. Dang

[57] ABSTRACT

A turbulence-generating cementing sub adapted to be coupled in screw-threaded end-to-end engagement between two sections of a string of well pipe, casing or liner and run through a cased oil well and cemented therein at a selected depth. The cementing sub is a short section of pipe having two sets of rigid flow-directing rubs or vanes welded or machined on the outer surface thereof. One set of ribs are angled on the sub to change the direction of a flowing cement slurry causing it to swirl around the sub in one direction. The adacent set of ribs are angled to the opposite side of the sub axis to interrupt at least a portion of the swirling cement slurry and cause it to swirl around the sub in the opposite direction thus generating a zone of turbulence in the flowing cement slurry between two strings of well pipe or casing. The rigid ribs also act as centralizers for the inner pipe or casing.

16 Claims, 8 Drawing Figures

TURBULENCE CEMENTING SUB

This invention relates to a device adapted to be coupled into a well pipe liner and positioned in the lower end of a well casing for creating turbulence in a fluid such as a cement slurry flowing past the device in the annular space between the well liner and the well casing. In particular, this invention relates to such a device employing angularly positioned rigid ribs or vanes for imparting a circumferential motion to the flowing fluid around the well liner in one direction and then in another direction to thereby generate the desired turbulence.

BACKGROUND OF THE INVENTION

As is well known to those skilled in the art, when a well pipe or liner is positioned within a well bore or casing and a drilling fluid is circulated in the annular space between the well liner and the well casing, the drilling fluid may assume a "channelling flow" within the annular space. In this channelling flow condition only a portion of the fluid within the annular space is flowing relative to the well liner and well casing and this flowing portion assumes and follows passages or channels formed within the remainder of the drilling fluid that is remaining relatively static. This formation of channels and creating channelling flow occurs as a result, at least in part, of the gelling properties of the drilling fluid or mud in that, if the drilling fluid is allowed to remain in the static condition for a period of time, it will gel and a substantial hydraulic or mechanical agitating force is needed to again return the entire column of drilling fluid to a flowing fluid state.

During many procedures and processes in the drilling and completion of a well, such as cementing a well liner in a well casing and well bore, this channelling flow is highly undesirable. For example, in a cementing operation if this channelling flow occurs, the cement slurry will follow these channels resulting in an incomplete displacement of the drilling fluid from the annular space. Under these circumstances the cement fill will be incomplete and probably inadequate to achieve the desired support and seal between the well liner and the well casing. It has been found that hydraulic forces may be developed for eliminating this channelling flow by using extremely high fluid pumping velocities, but the pressures and volumes required have made such a method impractical due to the number of pumps required at the well site. Additionally, the use of high pump pressures might affect the competency of some earth formations resulting in the breakdown of a weak formation with the subsequent loss of drilling mud and/or cement slurry into the formation. The mechanical agitation forces necessary to return the gelled drilling fluid to a fluid condition have been accomplished by the use of scratchers, turbulence generating devices, and the like on the exterior of the well pipe and then rotating or reciprocating the well pipe to agitate the drilling fluid and cement slurry.

Turbulence generating collars which also act as centralizers are well known to the art as shown in U.S. Pat. Nos. 2,312,600—2,602,512—and 3,072,195. In general, these devices are clamped onto the outside of a well casing being run into a well and then reciprocated and/or rotated therein by either moving the casing up and down or rotating it. This action causes these devices and the spring members carried thereby to scrape mud from the borehole wall. Additionally, some of these centralizers have outwardly extending blades or vanes at spaced intervals along the pipe so as to cause turbulence in the mud column as the blades or vanes are reciprocated or rotated.

The centralizer elements of these well known centralizers are in the form of bowed springs which contact the borehole wall as they extend between a pair of collars surrounding the pipe. The collars are generally arranged to rotate on the well pipe or casing or slide up and down on the surface of the pipe between a pair of stop members arranged to limit their movement. The main drawback with the presently known turbulence centralizers is that they may be clamped or pinned on the outside of a pipe string and that they are generally hinged in construction for ease of assembly on the pipe. While this type of construction of the centralizer is quite adequate when being used on the outside of a well casing, it often creates a problem when used on the outside of a well liner concentrically arranged within a well casing near the lower end thereof, and hung therein by means of a liner hanger engaging the inner surface of the well casing.

On more than one occasion, it has happened that when a well liner has been run several thousand feet down to the bottom of the well casing in the well, a spring type hinged centralizer that is clamped on the outside of the well liner below the hanger thereof will break loose and slide up the outside of the well liner and become lodged on the liner hanger in a manner such that the hanger becomes inoperative and cannot be set to engage the inner surface of the well casing as designed. In such instances, the entire string of pipe along with the liner has to be withdrawn from the well to fix the centralizer and/or the liner hanger. Additionally, the spring bows of this type of hanger are not sufficiently rigid in some instances and take up too much space outside the pipe so that it cannot be run through a well casing where the internal diameter thereof is only slightly greater than the outside diameter of the well liner.

The use of bi-directional vanes on the outside of a pipe string within a well which also serve to centralize the pipe string within the well are shown in U.S. Pat. No. 3,176,771. The vanes of this mud scraper are arranged on the pipe for rotational and transitional motion along its axis. Thus, the flow of fluid caused by pumping cement within the casing on which they are mounted will cause the vanes to rotate about the casing.

SUMMARY OF THE INVENTION

Accordingly, it is a principle object of this invention to provide a novel form of well cementing tool for creating turbulence in the annular space between pipes containing a mud or cement column, and which tool is particularly adapted to withstand severe treatment when the casing or well liner sections in which the device is installed are lowered into a well.

It is another principle object of this invention to provide an improved form of a cementing tool for creating turbulence in the annular space between a well liner and well casing which contains a mud or cement column, with the tool acting as a rigid centralizer for the well liner within a casing.

Another object of this invention is to provide a turbulence generator cementing sub which will be highly effective without the need to rotate or reciprocate the well liner into which it is coupled.

A further object of this invention is to provide a novel form of a turbulence generating device or sub adapted to be coupled into a well liner wherein bi-directional rigid vanes or ribs impart bi-directional circumferential swirling motion to fluid flowing past the device.

Another object of this invention is to provide a novel form of turbulence generating well liner device wherein a plurality of bi-directional rigid metal vanes or ribs extend outwardly and circumferentially of the well liner to circumferentially divert fluid flowing longitudinally past the device in first one direction and then another in the annular space between the well liner and a well casing.

A further object of this invention is to provide a novel form of turbulence generating device having a plurality of rigid angularly extending metal vanes or ribs that extend outwardly to substantially engage the well casing inner wall so as to act as a rigid centralizer for the well line.

Another obJect of this invention is to provide a turbulence generator in the form of a short pipe sub which may be coupled in end-to-end arrangement in a well liner and having rigid vanes or ribs formed on said pipe sub in a manner such that the metalurgy of the pipe sub has been not deleteriously affected and the burst, collapse and tension characteristics of the sub are at least equivalent to the pipe sections forming the well liner.

BRIEF DESCRIPTION OF THE DRAWING

These and other objects of the present invention will appear hereinafter from a consideration of the drawing and description.

FIG. 1 shows a well borehole after it has been drilled and cased to selective depths.

FIG. 2 illustrates the apparatus of the present invention being assembled and run into the well.

FIG. 3 shows the apparatus of the present invention being run into a well at the end of a string of pipe.

FIG. 4 illustrates the apparatus of the present invention after it has been run to a predetermined depth in the well casing and anchored to the inner wall of the well casing.

FIG. 5 shows the apparatus of the present invention after it has been cemented in the well at its preselected location.

DESCRIPTION OF A PREFERRED EMBODIMENT

Figure 1:
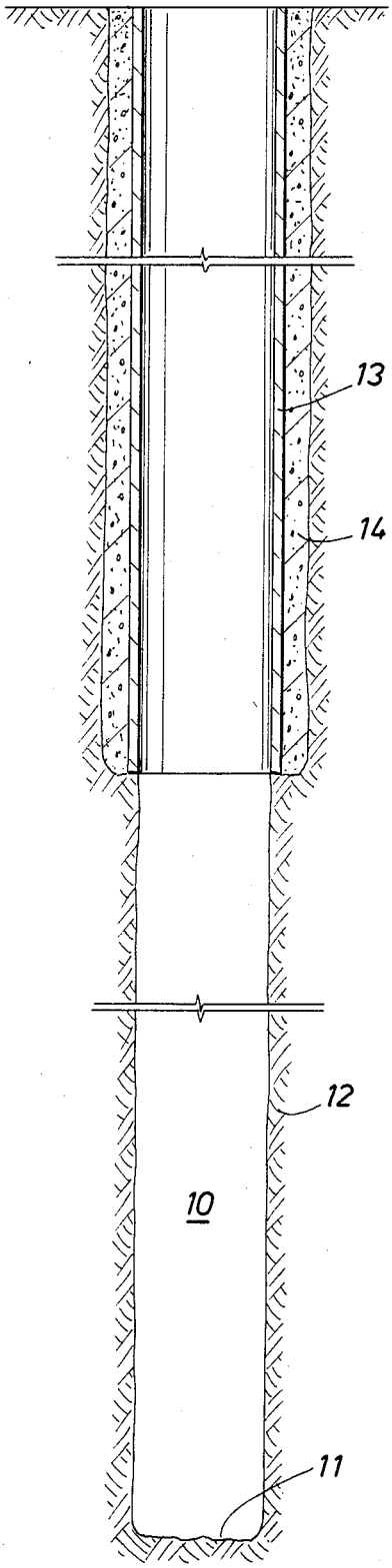
FIGS. 1 through 5 are diagrammatic views taken in a longitudinal cross-section of the apparatus of the present invention being installed in a well bore which has been drilled into earth formations.

Referring to FIG. 1 of the drawing, an oil or gas well 10 is illustrated as having been drilled to total depth, as represented by numeral 11, through an earth formation 12. A well casing 13 is illustrated as having been run into the well 10 and cemented therein by means of a cement sheath 14 surrounding the well casing at least at the lower end thereof to form an effective seal between the lower end of the casing 13 and the wall of the borehole 10. Although only a single string of casing 13 is shown for illustration purposes, it is recognized that a well may be drilled and provided with several concentric strings of casing. Since the present invention is only concerned with positioning a well liner 15 (FIG. 2) in the innermost well casing and anchoring it to the wall thereof, only one string of casing 13 will be considered in this description.

Figure 2:
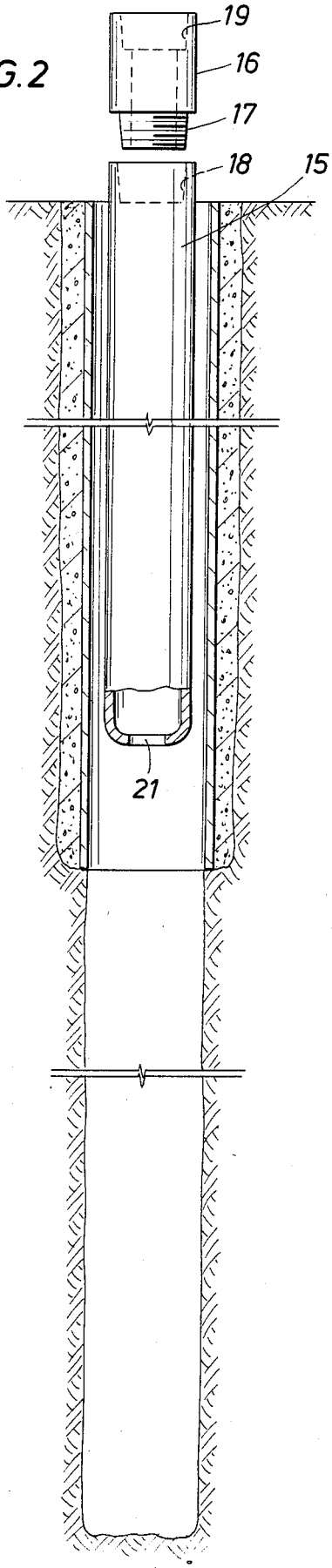

In FIG. 2 of the drawing, a tubular well liner 15 is shown as being run into the well. While the well liner 15 is illustrated as a single elongated tubular member, it is well known to the art that since the liners 15 may be several hundred feet long, they are made up of shorter sections of pipe, generally 20 to 40 feet in length, which are coupled together in an end-to-end relationship, preferably by screw threads. Suitable apparatuses are arranged at the top of the well within a derrick (not shown) for making up tubular strings of casing or well liner and suspending them while being lowered into the borehole 10. Thus, in FIG. 2 a turbulence cementing sub 16 is diagrammatically shown prior to being coupled into the top of the well liner 15. The cementing sub 16 is provided at its lower end with a threaded coupling joint 17 adapted to be seated in a mating coupling joint 18 in the upper end of the liner 15. In a like manner the upper end of the cementing sub 16 is provided with a threaded coupling joint 19 so that it may be coupled to other sections of a liner or to other apparatus. The lower end of the well liner 15 is provided with an opening 21 for permitting the passage of drilling mud or cement slurry therethrough. The pipe making up a well liner, and the well casing through which it is run, are available in many different diameters and the diameters chosen depend on many factors. For example, a $9\frac{5}{8}''$ diameter liner may be run through a well casing $11\frac{1}{4}''$ in outside diameter. Similarly, a liner having an outside diameter $7\frac{5}{8}''$ may be run through a $9\frac{5}{8}''$ diameter casing which has an inside diameter of 8.535".

Figure 3:
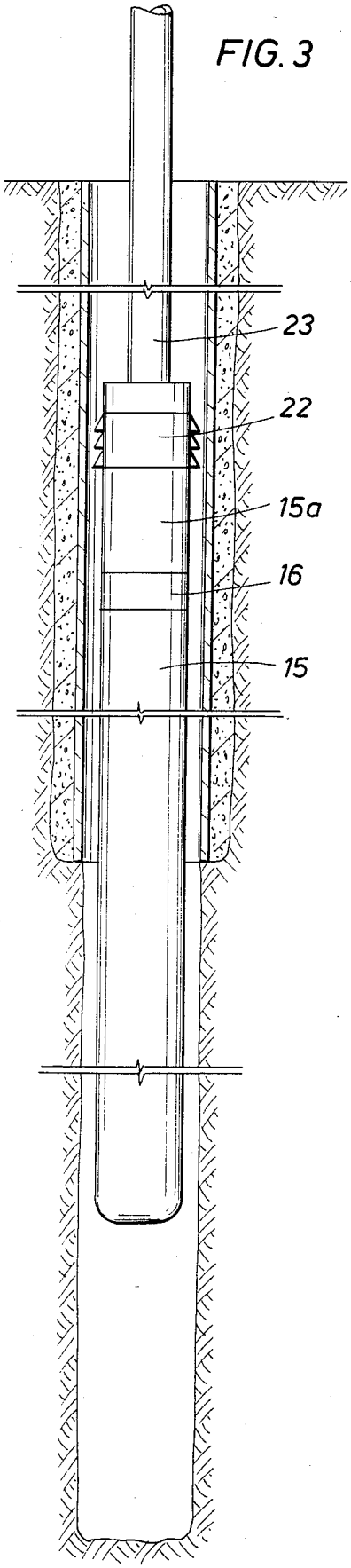

In FIG. 3, the well liner 15 is shown as having a turbulence cement sub 16 coupled therein with another section of well liner **15*a* threaded into the top of the cement sub 16. In turn, a casing or liner hanger 22 is connected to the top of the liner section 15*a* and the entire apparatus lowered into the well on a lowering pipe string 23 which may be made of any suitable pipe, preferably drill pipe. The liner 15** and its associated apparatus is lowered by means of the pipe string from the surface and cemented in the well by pumping cement slurry through the pipe string.

Figure 4:
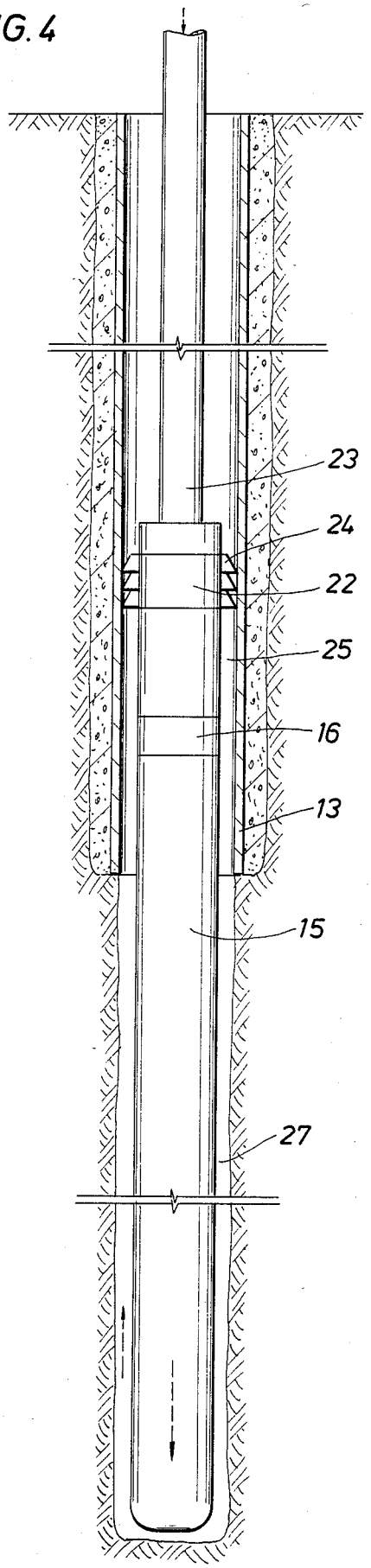

In FIG. 4, the pipe string 23 has been used to lower the liner 15 and its hanger 22 to a preselected position within the well casing 13. At this point, the latching dogs 24 of the liner hanger 22 are actuated and grip the inner wall of the casing 13 to establish an annular space 25 between the outer surface of the liner 15 and the inner wall of the casing 13. Since liner and casing hangers 22 are well known to the art and are manufactured by many supply companies, their construction and operation will not be further described here as they do not form any part of the present invention.

The length of the annular space 25 determines the length of the cement or concrete seal 26 (FIG. 5) formed between the outer wall of the liner 15 and the inner wall of the casing 13. The length of the annular space 25 depends upon the preselected height above the lower end of the casing 13 at which the liner hanger 22 is positioned when it is actuated. This distance or height depends on many factors from well to well, such, for example, as the formation pressures to be contained during further drilling production, the spacing between the well liner and the casing, etc.

When employing the turbulence cementing sub of the present invention, the hanger 22 is set at least 50 feet above the lower end of the casing 13 and may be as much as 600 feet above the lower end of the casing 13 depending upon the length of seal needed and number of turbulence cementing subs 16 being employed in a liner.

It is often desirable to employ 2 or more turbulence cementing subs in the well liner. In one case where a 9⅝" well liner was run, one cementing sub was located 50 feet above the bottom of the casing and a second one was located 130 feet above the bottom of the casing. In another example, a 5-inch well liner was run with one cementing sub two joints (approximately 80 feet) below the hanger and a second cementing sub five joints (about 200 feet) below the hanger. While running 7⅝" well liner in another well, four cementing subs were used in accordance with the present invention, one being one joint below the hanger, a second three joints below the hanger, a third four joints below the hanger and the fourth was six joints below the hanger. In all cases in these high pressure wells successful cementing seals were established between the liner and the casing. In other similar wells in the same area, inadequate cementing seals have been encountered prior to employing the turbulence cementing subs of the present invention.

Figure 5:
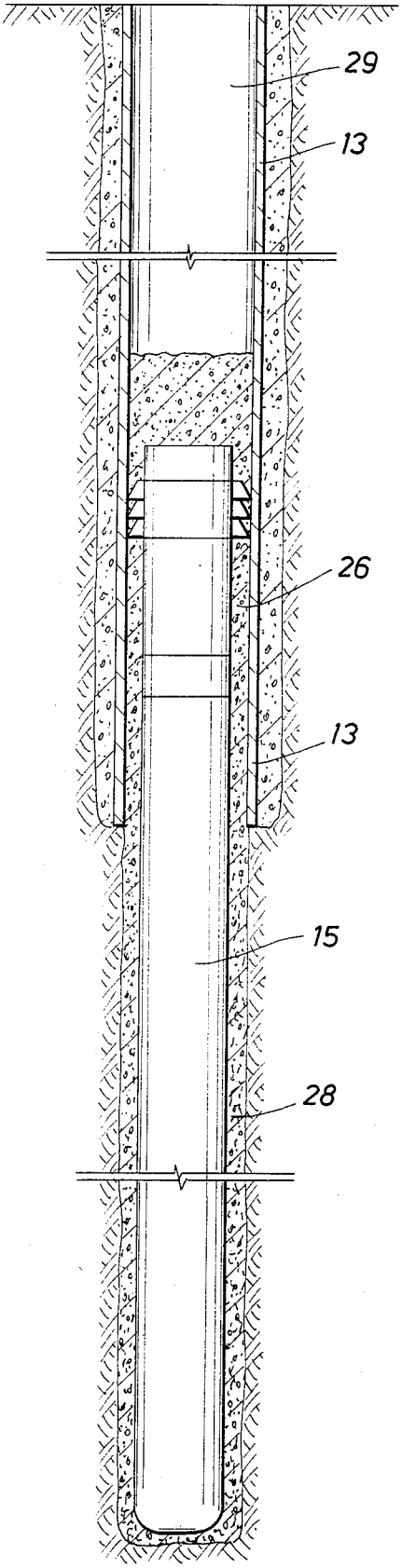

Referring to FIGS. 4 and 5, after the liner hanger 22 has been actuated to anchor the liner within the casing 13, a cement slurry is pumped down through drill pipe 23 down through the hanger and through the cementing sub 16 and then down the remaining length of the well liner to be discharged out of the opening 21 (FIG. 2) in the bottom of the liner 15 with the bottom of the liner preferably hanging just off the bottom 11 of the borehole 10. This allows the cement slurry to be circulated out the bottom of the liner and up the annular space 27 to form a concrete sheath 28 between the liner 15 and the borehole wall. As the cement slurry passes upwardly into the annular space 25 between the well liner 15 and the well casing 13, it passes one or more turbulence subs 16 which starts to swirl the cement slurry in one direction and then abruptly reverses or alters the direction of swirl to the opposite side of the liner, thus providing a zone of turbulence which prevents any channelling of mud or other fluid in the cement seal 26 which is formed therein. With the well liner 15 cemented in place as shown in FIG. 5, the lowering drill string 23 is retrieved and pulled out of the well. Subsequently, any cement above the top of the liner is removed in any manner well known to the art, as, for example, by drilling or removing with any other cleanup tool. This establishes communication between the interior of the well liner, now filled with a non-setting fluid, and the bore 29 of the casing 13.

Figure 6:
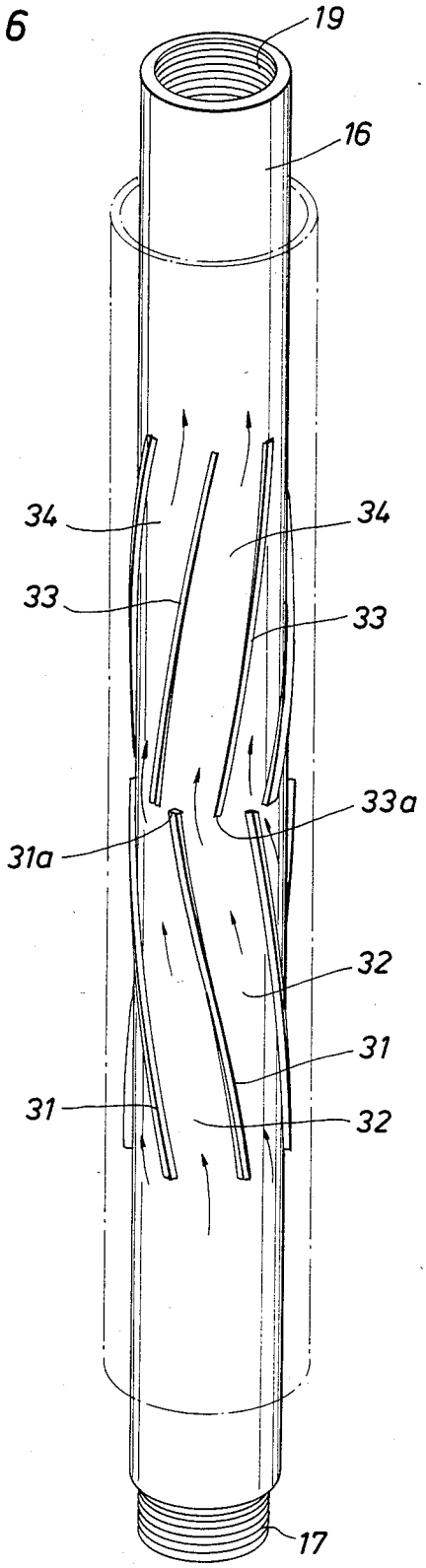
FIG. 6 is a longitudinal view illustrating a turbulence sub of the present invention positioned within a section of well casing.

The turbulence cementing sub 16 of the present invention is shown in greater detail in FIG. 6 as comprising a short tubular member having an axial bore therethrough. Connector means in the form of screw threads 17 and 19 are provided at opposite ends of the body member 16 for connecting the sub in end-to-end axial alignment between sections of the well liner 15. A first set of a plurality of elongated raised rigid ribs or vanes 31 are fixedly formed on the outer surface of the tubular sub 16 over a portion of the length thereof. A flow channel 32 is formed between each pair of ribs 31 along the outer surface of the tubular tub 16. The ribs 31 are positioned at an oblique angle to the axis of the tubular sub to one side thereof so as to cause a swirling motion around the axis of the sub to any fluid passing through the channel 32.

The ribs 31 are rigid so that the plurality of ribs located on the outer surface of the sub act as centralizer elements on the sub so as to keep the well liner 15 centrally positioned within the well casing 13. This is especially important in slanting wells or wells that deviate from the vertical where the well liner would tend to lay against the low side of the well casing which would result in a non-uniform thickness to the cement seal in the annular space between the well liner and the casing. The rigid ribs 31 extend to a height above the cylindrical surface of the tubular sub sufficient so that the outer edges of the ribs are spaced from 1/32 to ½ inch from the inner wall of a surrounding well casing in which the liner is to be positioned.

Since the ribs 31 extend helically around the outer surface of the tubular sub 16, as few as two ribs may be employed but three or four are preferred and as many as six are used on larger diameter liners, say one 9⅝" in diameter. Each rib extends helically around a fraction of the circumference of the sub body equal to at least 1/N of the circumference of the tubular sub body, where N is equal to the number of ribs running in the same direction. The angle of the ribs 31 with the axis of the sub body may vary from 10° to 45° depending upon the pipe tolerences and well conditions encountered.

Since it is an object to the present invention to provide turbulence cementing subs having the same burst, collapse and tension rating as the pipe used in the well liner, it is preferred that the tubular body of the sub 16 be made of thick-walled pipe which is machined down so that the ribs 31 extend upwardly from the surface to the preselected height. Machining of the ribs on the cementing sub is preferred where the subs 16 are to be used in problem wells where welding of ribs onto the outer surface may change the properties of the metal forming the body of the sub. In low pressure wells where no corrosive materials are encountered and change in properties of the metal of the sub are not important, the ribs may be welded to the outer surface of the tubular sub in a manner well known to the art.

Referring back to FIG. 6 of the drawing, it may be seen that the turbulence cementing sub body 16 of the present invention is provided with a second set of a plurality of elongated raised rigid ribs or vanes 33 which are fixedly formed on or secured to the outer surface of the tubular body over a selected length thereof, the ribs 33 being axially spaced from, and adjacent to, said first set of ribs 31. The length of the ribs may be from a few inches long to a foot or two in length. Generally, the turbulence sub body 16 may be two feet or more in length but is preferably around 4 feet long on the average. A second set of flow channels 34 are formed between each pair of the second set of raised ribs 33 on the body 16. The second set of ribs 33 are positioned at an oblique angle to the axis of the tubular sub 16, with the angle being taken on the opposite side of the axis in a direction angularly offset from the angle of the first set of ribs 31 and to the opposite side of the axis.

Figure 8:
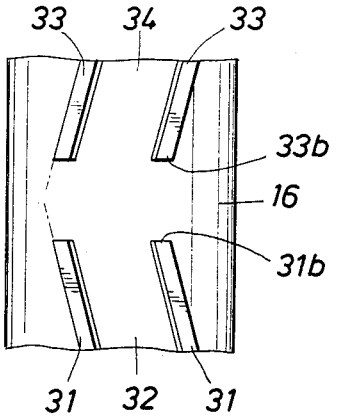

As shown in FIG. 6, each of the ends of the first set of ribs 31 is positioned on the body of the sub 16 in line with the second flow channel 34 between the second set of ribs 33. Thus it may be seen that the upper end 31*a* of lower rib 31 terminates at the lower end of flow channel 34 between the upper ribs 33. In a like manner the lower end 33*a* of each upper rib 33 terminates in the flow channel 32 between a pair of lower ribs 31. Hence, the adjacent ends 31*a* and 33*a* of ribs 31 and 33, respectively, may be circumferentially displaced one from the other. Alternatively, as shown in FIG. 8, the adjacent ends 31*b* and 33*b* of the lower and upper ribs 31 and 33, respectively, may be displaced axially one from the other with the same resultant formation of a zone of turbulence between the ends of the ribs 31*b* and 33*b*. As it may be seen, cement slurry flowing up channel 32 is given a chance to pass on either side of each of the ribs 33 in the embodiment of FIG. 8, the same as if the configuration of FIG. 6 were employed.

Figure 7:
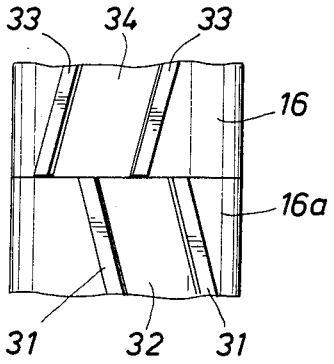
FIGS. 7 and 8 are longitudinal views illustrating alternative embodiments of the construction and arrangement of the ribs on the outer surface of the turbulent sub of FIG. 6.

While the sub body 16 of FIG. 6 has been shown as a unitary tubular element with rigid ribs carried thereon directed to the right and left of the axis of the body member 16, the body may be formed as two separate elements 16 and 16*a* as shown in FIG. 7 which would be connected together with suitable threaded couplings or other connector means similar to threads 17 and 19 shown in FIG. 6. The arrangement of FIG. 7 would be used mainly to facilitate manufacture of the turbulence cementing sub 16 when the ribs are machined on the surface thereof. While the invention has been described in FIGS. 1 through 5 with only one cementing sub 16 being employed in the well liner 15, it is understood that more than one cementing sub may be employed. Additionally, the overlap between the bottom of the well casing 13 and the well liner 15 may be greater on higher pressure wells. In one test case the overlap was about 400 feet with a fluid-tight seal resulting.

It may be seen that the present invention is directed to a method of preventing channelling in a cement sheath or seal that is formed in the annular space between a well liner and a well casing positioned in a well which has been drilled into earth formations. The improvement of the method comprises coupling a reverse-turbulence rigid tubular cementing pipe sub in axial screw threaded engagement between two sections of the well liner below the liner hanger 22 thereof. First and second sets of cement-slurry flow-directing rigid ribs 31 and 33 (FIG. 6) are axially displaced one from the other and fixedly and rigidly carried by and spaced around the circumference of the cementing sub 16 on the outer surface thereof. The ribs 31 and 33 have channels 32 and 34, respectively, formed therebetween with one set of ribs slanting at an angle to the right of the axis of the sub 16, and the other set of ribs 33 slanting at an angle to the left of the axis of the sub 16. The well liner 15, hanger 22, and cementing pipe sub 16 are run down the well casing 13 to a selected position therein to form the annular space between the liner and the well casing. The liner hanger 22 is then set to fixedly secure the top of the liner to the inner wall of the well casing 13 with at least 50 feet of the top of the liner concentrically arranged within the lower end of the well casing. With the remaining lower length of the well liner 15, extending below the bottom of the casing.

Cement slurry is then pumped down through the drill pipe string 23 used to run the liner into place. The cement slurry is pumped through the hanger 22 and through the cementing sub 16 and liner 15 so as to flow out the lower end of the liner and up the outside thereof. A first zone of turbulence is created in the outwardly flowing cement slurry stream as it passes the turbulence cementing sub 16 with at least a portion of the cement slurry stream being channelled at an angle to the liner axis to cause the slurry portion to start to swirl around the well liner in one direction. Substantially immediately, the swirling cement flow is interrupted and caused to swirl around the well liner 15 in the other direction.

Pumping of the cement slurry past the zone or zones of turbulence and outwardly pass the liner hanger is continued to prevent channelling in the cement slurry that remains in the annular space 25. The cement slurry is then allowed to harden to form a solid sheath in the annular space 25 to form a fluid impervious seal prior to producing the well.

After the cement seal has hardened, the seal is tested. The seal may be tested by either (or both) of two methods. First, a positive pressure test of the cement seal may be conducted by applying pressure at the surface to the closed well. This increases the hydrostatic pressure or head on the seal to a level greater than the in situ hydrostatic pressure of the open hole formations. Or, a negative test of the cement seal is conducted by lowering the hydrostatic fluid density and/or pressure on top of the cement seal to a level below the in situ hydrostatic pressure of the open hole formations. Leaks are detected by a loss of gage pressure in the first test and positive well flow in the latter test.

While the turbulence cementing sub of the present invention has been described as being coupled into a well liner being hung from and cemented in a well casing, it is understood that the turbulence cementing sub may be also coupled into a string of well pipe, conduit or casing being run through and cemented in a well casing already in a well. Thus, upon hanging the inner casing or pipe within the outer casing in a manner well known to the art and cementing it therein, zones of turbulence would be created between the pipe and casing opposite each turbulence cementing sub that was coupled into the well pipe.

I claim as my invention:

1. A turbulence-generating cementing sub adapted to be connected into a well casing and pass downwardly into a portion of a a second well casing and be positioned therein, said sub comprising:

a short tubular body member, casing thread means at each end of said body member for connecting said body member in end-to-end axial alignment between two sections of a well casing, a plurality of first rigid flow-directing means formed on the outer surface of said tubular body member and extending outwardly therefrom and fixedly and integrally arranged on said body member in spaced-apart parallel relationship in a direction to cause a cement slurry flowing thereby to swirl around said body member in one direction toward one end of said body member and at an angle to one side of the axis thereof, and a plurality of second rigid flow-directing means formed on the outer surface of said tubular body member in spaced-apart relationship and extending outwardly therefrom adjacent to and axially displaced from said first flow-directing means and fixedly and integrally arranged on said body member in a second direction at an angle to the other side of the axis thereof to cause cement slurry flowing thereby to swirl around said body member is said second direction toward the same end of said body member to cause a zone of turbulence in said flowing cement slurry, said flow directing means extending outwardly from the body member an overall distance less than the inner diameter of the well casing into which it is passed and positioned.

2. A turbulence-generating cementing well liner sub adapted to pass into a well casing and be hung near the lower end thereof, said sub comprising:

a short substantially cylindrical tubular body member having an axial bore therethrough, thread means at each end of said body member for connecting said body member in end-to-end axial alignment between threaded end sections of a well liner, a first set of a plurality of elongated raised rigid ribs fixedly formed on the outer surface of said tubular body member over a portion of the length thereof, a first set of fluid flow channels formed between each pair of ribs and on either side thereof, said first set of ribs positioned at an oblique angle to the axis of said tubular body member to one side thereof, a second set of a plurality of elongated raised rigid ribs fixedly formed on the outer surface of said tubular body member over a portion of the length thereof and being axially spaced from and adjacent to said first set of ribs, and a second set of flow channels formed between each pair of said second set of ribs, said second set of ribs being positioned at an oblique angle to the axis of said tubular member, said angle being taken on the opposite side of said axis in a direction angularly offset from the angle of said first set of ribs and to the opposite side of said axis, said flow directing means extending outwardly from the body member an overall distance less than the inner diameter of the well casing into which it is passed and positioned.

3. The apparatus of claim 2 wherein the ends of said first set of ribs are circumferentially displaced from the adjacent ends of said second set of ribs.

4. The apparatus of claim 2 wherein each of the ends of said first set of ribs being positioned on said body member in line with a second flow channel between a second set of ribs.

5. The apparatus of claim 2 wherein the rigid ribs extend to a height above the cylindrical surface of said tubular body member sufficient so that the outer edges of the ribs are spaced from 1/32 to ½ inch from the inner wall of a surrounding well casing in which the liner is to be positioned.

6. The apparatus of claim 2 wherein each set of elongated ribs extend in helical manner on the surface of said tubular body member, each rib extending around a fraction of the circumference of said body member equal to at least 1/N of the circumference of the tubular body member, where N is equal to the number of ribs running in the same direction.

7. The apparatus of claim 2 wherein the ends of the first set of ribs are displaced axially and circumferentially to the adjacent ends of said second set of ribs.

8. A tubular well liner adapted to be hung in a well casing in a substantially concentric manner near the lower end thereof and at least 50 feet above a shoe on the lower end of the well casing whereby an elongated annular space is formed between the inner wall of said casing and the outer wall of said well liner, said well liner comprising:

a plurality of sections of tubular liner pipe having threaded connections at the ends thereof for connecting said sections together in an end-to-end arrangement to form a pipe string hundreds of feed long, a liner hanger fixedly secured to said liner adjacent the upper end thereof for anchoring said liner to a surrounding well casing at least 50 feet above the lower end thereof for receiving a cement seal between the liner and the casing, and rigid turbulence-gnerating tubular cementing means including outwardly-extending axially-displaced ribs angularly-disposed at opposite angles on said means coupled in screw-threaded engagement between at least two sections of said tubular well liner positioned above the lower end of a well casing to form a integral portion of the well liner at a selected location below said liner hanger for creating a zone of turbulence below the hanger and in the annular space between the liner and the casing.

9. The apparatus of claim 8 wherein said turbulence-generating tubular cementing means includes at least first and second axially-spaced sets of outwardly-extending rigid ribs fixedly set on the outer-surface of said tubular cementing means at oblique and opposite angles to one another formed with the axis of said tubular cementing means on opposite sides of said axis, for swirling in one direction at least a portion of a cement slurry flowing past said first set of ribs, and for reversing the direction of swirl of at least a portion of said cement slurry flowing past said second set of ribs.

10. The apparatus of claim 9 wherein cement slurry flow channels are formed between each pair of each of said first and second axially spaced sets of rigid outwardly-extending ribs.

11. The apparatus of claim 10 wherein said first and second sets of ribs are positioned on the outer surface of said tubular cementing means in a manner such that each of the ends of the first set of ribs is directed at a flow channel between the adjacent ends of a pair of said second set of ribs, whereby a zone of turbulence is formed between the adjacent ends of said first and second set of ribs.

12. The apparatus of claim 9 wherein at least two turbulence-generating tubular cementing means are employed with each being coupled in screw-threaded engagement between two sections of said tubular well liner at selected intervals therealong below said liner hanger, all of said tubular cementing means being positioned on the well liner so as to be located in the annular space between the well liner and a well casing when the well liner is hung in its selected position within the well casing.

13. The apparatus of claim 9 wherein the diameter of the tubular cementing means and the height of the ribs carried thereby is selected such that the outer edges of the ribs are within the range of 1/32 to ½ inch from the inner wall of a well casing when axially positioned therein.

14. A method of preventing channeling in a cement sheath and seal in the annular space between a well liner made of pipe sections and a well casing positioned in a well drilled into earth formations, said well liner being run into the well by a lowering and cementing pipe string and hung in said well casing at least 50 feet above the lower end thereof by means of a liner hanger and then pumping cement down the pipe string and into the annular space between the well liner and the well casing, wherein the improvement comprises, coupling a reverse-turbulence rigid tubular cementing pipe sub of a diameter less than the inner diameter of the well casing and in axial screw-threaded engagement between two sections of the well liner below the hanger thereof, providing first and second sets of cement-slurry flow-directing rigid ribs axially displaced one from the other and fixedly and rigidly carried by and spaced around the circumference of the sub on the outer surface thereof, said ribs having channels therebetween, one set of ribs slanting at an angle to the right of the axis of the sub, the other set of ribs slanting at an angle to the left of the axis of the sub, running said well liner and hanger and cementing pipe sub down a well casing to a selected position therein to form an annular space between said liner and well casing, setting the liner hanger to fixedly secure the top of the liner to the inner wall of the well casing with at least 50 feet of the top said liner concentrically arranged within the lower end of said well casing with the cementing pipe sub located above the lower end of the well casing and with the remaining lower length of said well liner extending below said casing, pumping cement slurry down said pipe string, through said liner, up the outside thereof and substantially vertically and axially upwardly into and through the annular space between the liner and the casing, creating in the annular space between the well liner and the well casing at least a first zone of turbulence in the substantially axially-flowing cement slurry by channeling at least a portion of the cement slurry stream at an angle to the liner axis to cause said slurry portion to start to swirl around said well liner in one direction and substantially immediately interrupting the flow of said slurry portion to cause it to swirl around said well liner in the other direction, continuing the pumping of cement slurry past said zone of turbulence and upwardly past said liner hanger to prevent channeling in the cement slurry that remains in the annular space, and allowing said cement slurry in said annular space to harden to a solid sheath in the annular space to form a fluid impervious seal prior to producing said well.

15. The method of claim 14 including the step of creating at least a second zone of turbulence axially spaced from said first zone of turbulence in the flowing cement slurry in the annular space between said well liner and said well casing.

16. The method of claim 14 including the step of substantially centering the upper portion said liner within the lower end of said well casing prior to pumping cement in the annular space between the liner and casing.

* * * * *